US008794596B2

(12) United States Patent
Kim et al.

(10) Patent No.: US 8,794,596 B2
(45) Date of Patent: Aug. 5, 2014

(54) WIRE TENSIONER

(75) Inventors: Jeong-Ryeol Kim, Gyeonggi-do (KR); Woon-Seok Oh, Incheon-si (KR)

(73) Assignee: Samwoo Geotech Co., Ltd., Seoul (KR)

( * ) Notice: Subject to any disclaimer, the term of this patent is extended or adjusted under 35 U.S.C. 154(b) by 0 days.

(21) Appl. No.: 13/284,588

(22) Filed: Oct. 28, 2011

(65) Prior Publication Data

US 2012/0297694 A1 Nov. 29, 2012

Related U.S. Application Data

(63) Continuation of application No. PCT/KR2009/005199, filed on Sep. 11, 2009.

(30) Foreign Application Priority Data

Apr. 28, 2009 (KR) ..... 10-2009-0036930

(51) Int. Cl.
*E21B 19/00* (2006.01)
*E04C 5/08* (2006.01)

(52) U.S. Cl.
USPC ..... 254/29 A; 52/223.1; 52/223.13

(58) Field of Classification Search
USPC ..... 254/29 A, 134.4; 14/21, 22, 23; 403/314, 368, 369; 52/223.1–223.14; 226/97.1
See application file for complete search history.

(56) References Cited

U.S. PATENT DOCUMENTS

| | | | | |
|---|---|---|---|---|
| 2,637,895 | A * | 5/1953 | Blaton | 29/452 |
| 3,597,830 | A * | 8/1971 | Yegge | 29/452 |
| 3,658,296 | A * | 4/1972 | Yegge | 254/29 A |
| 3,787,957 | A * | 1/1974 | Andrews | 29/452 |
| 3,837,621 | A * | 9/1974 | Gomez | 254/29 A |
| 3,868,850 | A * | 3/1975 | Davison et al. | 73/862.42 |
| 4,405,114 | A * | 9/1983 | Macchi | 254/29 A |
| 4,598,897 | A * | 7/1986 | Aikioniemi | 254/29 A |
| 4,633,540 | A * | 1/1987 | Jungwirth et al. | 14/22 |
| 4,648,146 | A * | 3/1987 | Nutzel et al. | 14/21 |
| 5,083,469 | A * | 1/1992 | Percheron et al. | 73/862.42 |
| 5,809,710 | A * | 9/1998 | Jungwirth et al. | 52/223.1 |
| 6,944,550 | B2 * | 9/2005 | Marchetti | 702/42 |
| 7,010,824 | B2 * | 3/2006 | Stubler et al. | 14/22 |
| 7,275,462 | B2 * | 10/2007 | Faus et al. | 81/57.38 |
| 2012/0297694 | A1 * | 11/2012 | Kim et al. | 52/1 |

FOREIGN PATENT DOCUMENTS

| | | |
|---|---|---|
| CN | 2597610 | 1/2004 |
| JP | 2002-235303 | 8/2002 |
| JP | 2003-509605 | 3/2003 |
| JP | 2003-286759 | 10/2003 |

OTHER PUBLICATIONS

Notice of Preliminary Rejection issued by the State Intellectual Property Office of People's Republic of China on Aug. 20, 2013.

* cited by examiner

*Primary Examiner* — Lee D Wilson
*Assistant Examiner* — Jamal Daniel
(74) *Attorney, Agent, or Firm* — IP & T Group LLP

(57) ABSTRACT

A wire tensioner includes a plurality of rods that apply a tensile force to a plurality of wires. A fluid pressure providing means applies fluid pressure to the plurality of rods to apply the tensile force to the plurality of wires. A fluid control means is connected to the fluid providing means and to the plurality of rods to separately control a fluid pressure applied to each of the plurality of rods.

15 Claims, 11 Drawing Sheets

WIRE TENSIONER

CROSS-REFERENCE TO RELATED APPLICATIONS

This application is a continuation of PCT/KR2009/005199 filed on Sep. 11, 2009, which claims priority of Korean patent application number 10-2009-0036930 filed on Apr. 28, 2009. The disclosure of each of the foregoing applications is incorporated herein by reference in its entirety.

BACKGROUND OF THE INVENTION

The present invention relates to a wire tensioning apparatus for pulling wires arranged inside a structure to reinforce the structure.

In general, an elevated structure that is built to span a river, a strait, a canal, a traffic route, or a structure to provide passage over it is referred to as a bridge.

Such a bridge consists of an upper structure that allows for passage, and a lower structure that supports the upper structure. In case of the upper structure, there occurs a deflection phenomenon caused by a repetitive fatigue load and a repeated load or a self-weight load during or after the installation of the upper structure. As a result, a problem is caused in that the upper structure is unfortunately collapsed by its deflection phenomenon.

Thus, in an attempt to reinforce the upper structure, a plurality of wire bundles each of which is a bundle of approximately 10 to 14 wires is arranged inside the upper structure and is tensioned tightly, thereby preventing the upper structure from being deflected downward.

A wire tensioning apparatus is used to reinforce the structure. In this case, the wire tensioning apparatus is joined to one ends of wires to pull the wires. The wire tensioning apparatus includes a body, a plurality of rods that is at least partially joined to the inside of the body, and a clamp block coupled to the rods and configured to clamp the wires.

Fluid is introduced into the body of the wire tensioning apparatus and rods pull the wires while being displaced by the pressure of the fluid to cause the wires to be maintained in a tightly tensioned state. However, it is required that a large quantity of fluid should be supplied to the inside of the body while the plurality of rods is displaced axially simultaneously. A high-pressure fluid is needed to allow the plurality of rods to be moved simultaneously. For this reason, many loads are generated in the body, resulting in occurrence of a problem of damage of the body and the rods.

In the meantime, if the number of wires constituting the wire bundles is smaller than that of the rods, only some of the rods are connected to the wires via the clamp block. In this case, while the plurality of rods is displaced axially simultaneously, rods that are not connected to the wires are also displaced axially. Consequently, power loss occurs unnecessarily.

SUMMARY OF THE INVENTION

Accordingly, the present invention has been proposed to solve the above-mentioned problems associated with the conventional prior art.

An embodiment of the present invention is directed to a wire tensioning apparatus which is configured to allow a plurality of rods connected to a plurality of wires to be operated separately so that only a necessary rod can be operated, thereby minimizing power loss.

Another embodiment of the present invention is directed to a wire tensioning apparatus in which a plurality of rods is disposed to be inclined in a direction from one side to other side, thereby minimizing the entire volume of the wire tensioning apparatus and avoiding any interference with other wire tensioning apparatuses.

In accordance with an embodiment of the present invention, there is provided a wire tensioning apparatus including: a body including one or more rod bores axially defined therein; one or more rods formed to have a predetermined length and configured to be inserted at one end sides thereof into the rod bores so as to allow the rods to be displaced axially along the rod bores; a wire engagement means engaged to the other ends of the rods and configured to be displaced axially by the axial displacement of the rods; a pressure-supporting means comprising one or more support bars formed to have a predetermined length and connected at one ends thereof to the body, a pressure plate engaged to the other ends of the support bars, and one or more fixing pins engaged to the pressure plate to allow the wire engagement means to be disengaged from or engaged with the pressure-supporting means; a fluid control means comprising one or more pipes disposed at the other end side of the body and connected respectively at one ends thereof to the rod bores, one or more flow channels connected to the other ends of the pipes in such a fashion as to fluidically communicate with the interior of the pipes, a fluid block having one or more flow channel holes formed therein so as to be correspondingly connected to the flow channels, and one or more valves each engaged to each of the flow channels to selectively interrupt the flow channels.

In accordance with another embodiment of the present invention, the wire engagement means may include: an engagement block internally perforated in a longwise direction, the engagement block being fixed at one side thereof to the other end of the rod and being disengaged from or engaged with the fixing pin at the other side thereof; a clamp insert internally perforated in a longwise direction and disposed inside the engagement block, the clamp insert being formed to have a tapered shape which is gradually reduced in inner diameter in a direction from one end side toward the other end side and divided into plural segments; a clamp block at least partially inserted into the clamp insert and internally perforated in a lengthwise direction thereof, the clamp block being to have a tapered shape which is gradually reduced in outer diameter in a direction from one end side toward the other end side and being divided into plural segments; and a buffer guide disposed between the clamp block and the rod and including a buffer member disposed on the outer circumferential surface thereof so as to be buffered by the buffer member.

In accordance with still another embodiment of the present invention, the wire tensioning apparatus may further includes: a support body configured to be internally perforated in a lengthwise direction thereof and disposed between the body and the pressure plate to surround the rods, the support body being formed to have a tapered shape which is gradually in outer diameter in a direction from one side to the other side.

In accordance with yet another embodiment of the present invention, the wire tensioning apparatus may further includes: a detecting sensor joined to the pressure plate and configured to detect the axial displacement of the wire engagement unit; and a screen display part connected to the detecting sensor and configured to display the distance of the wire engagement unit displaced axially.

In accordance with a further embodiment of the present invention, in the construction of the wire tensioning apparatus, each of the rods may be internally perforated at the center thereof in a lengthwise direction thereof, and may be disposed inside each of the rod bores. In addition, the wire tensioning apparatus may further include: one or more guide tubes inserted at one ends thereof into the rods and connected at the other ends thereof to the body; one or more first caps disposed at one ends of the rods bores to allow the rods to be passed therethrough; and one or more second caps disposed at the other ends of the rod bores to allow the pipe to be passed therethrough. The rod has an increased linearity in its axial displacement within the rod bore by the guide tubes.

DESCRIPTION OF SPECIFIC EMBODIMENTS

Figure 1:
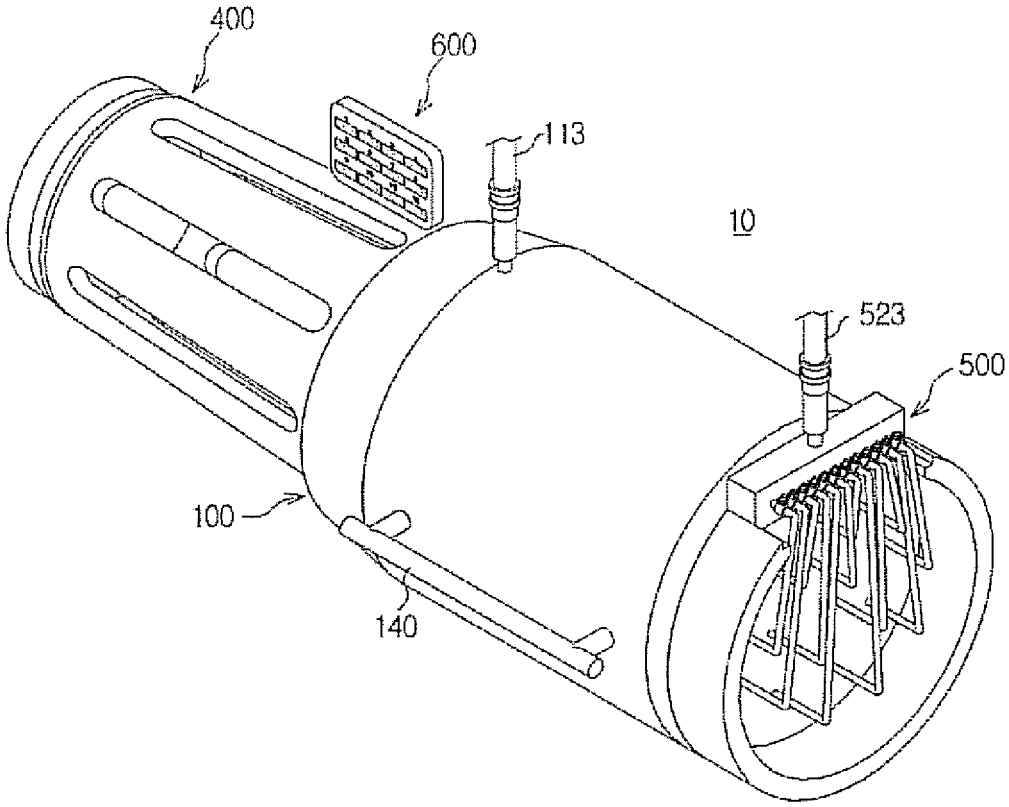
FIG. 1 is a perspective view illustrating a wire tensioning apparatus according to the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

A wire tensioning apparatus according to an exemplary embodiment of the present invention will be described hereinafter with reference to FIGS. 1 to 4.

Figure 2:
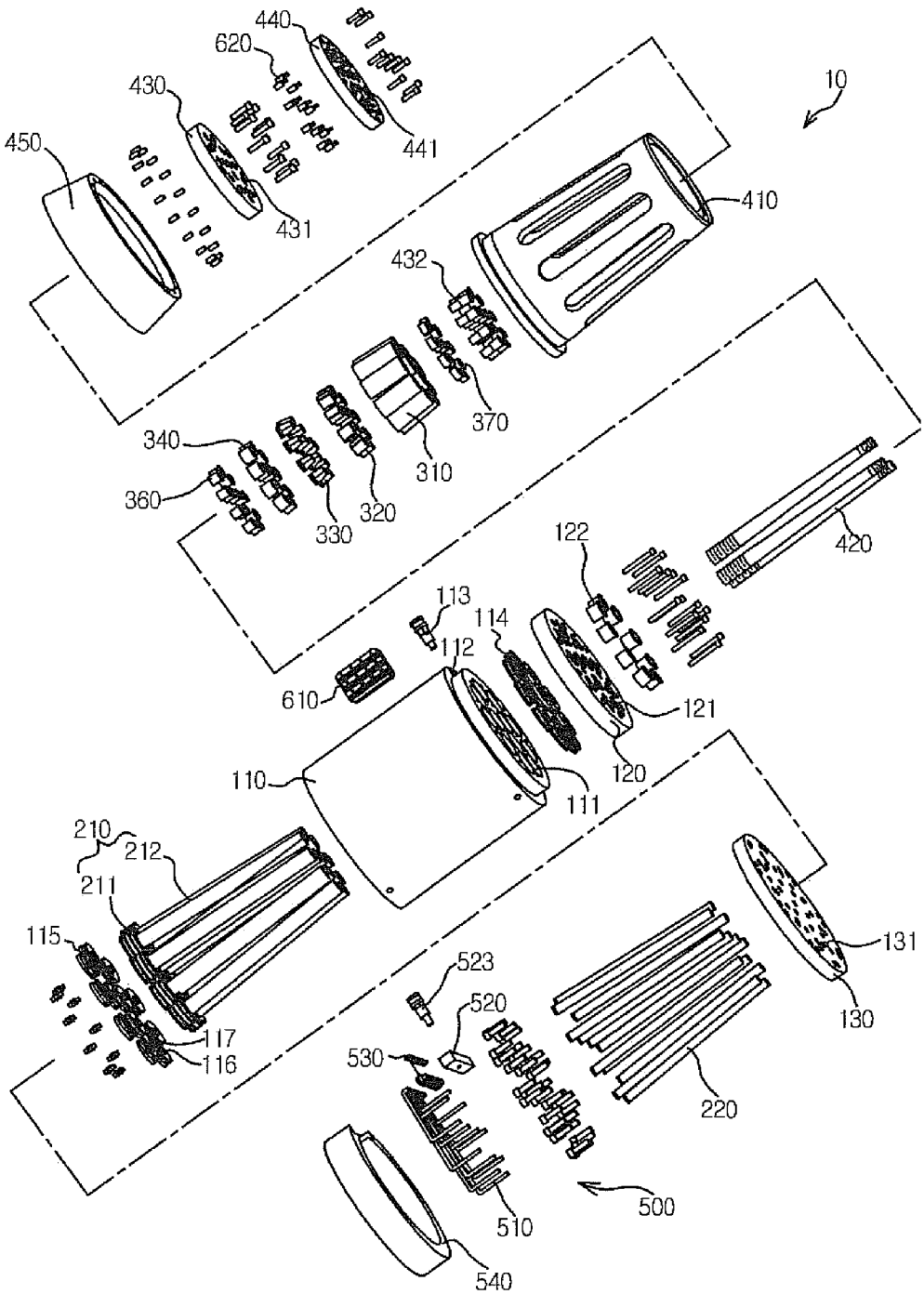
FIG. 2 is an exploded perspective view illustrating the wire tensioning apparatus shown in FIG. 1.
Figure 3:
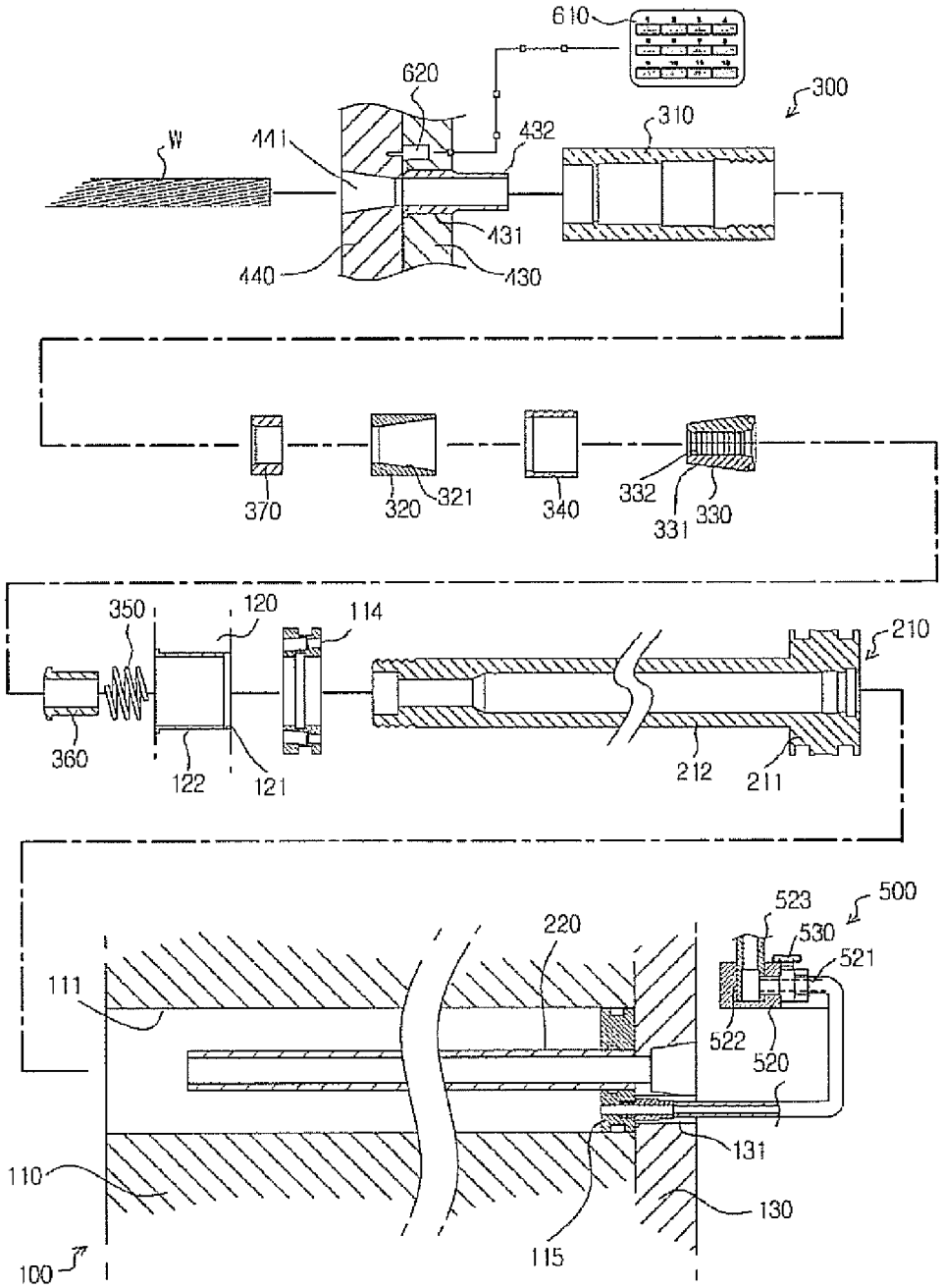
FIG. 3 is an exploded cross-sectional view illustrating the main elements of the wire tensioning apparatus shown in FIG. 2.
Figure 4:
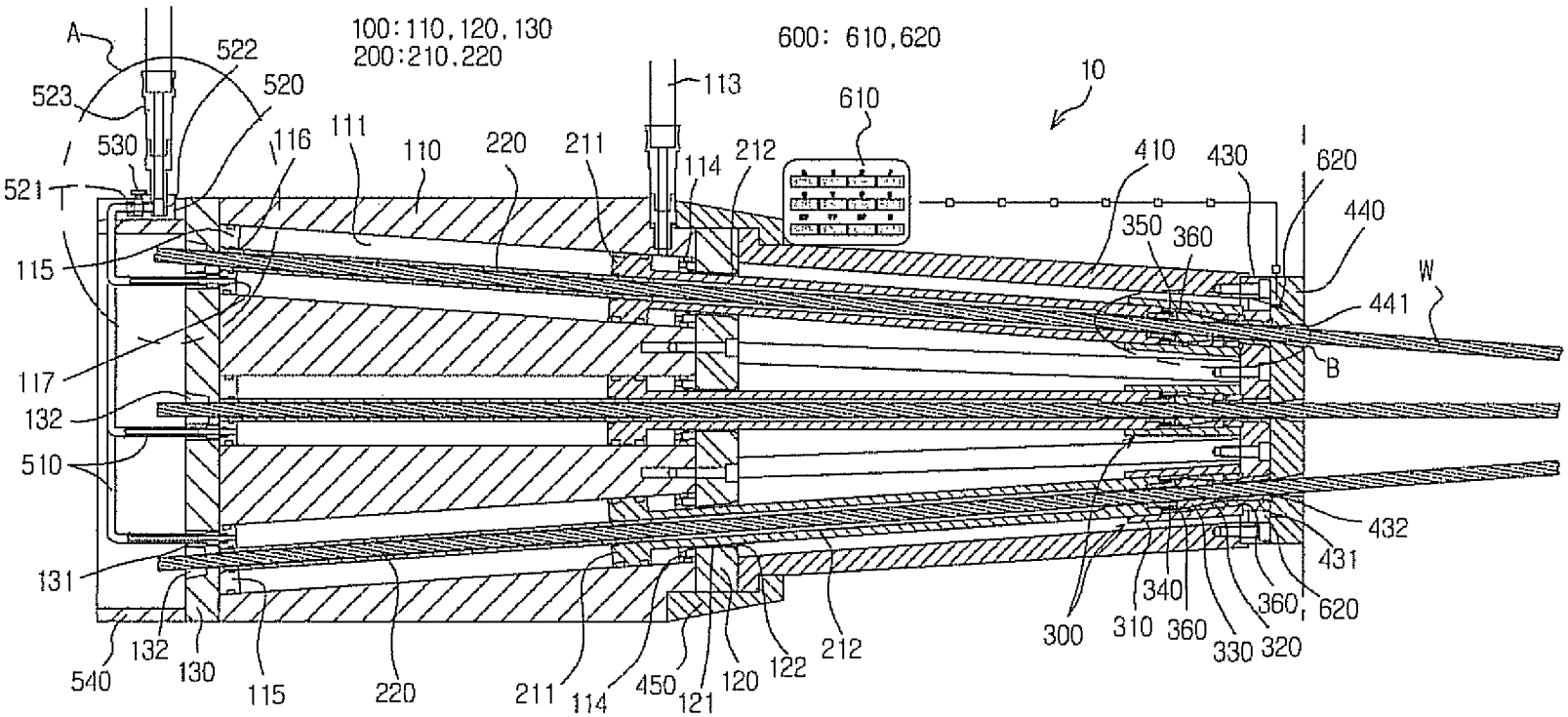
FIG. 4 is a cross-sectional view illustrating the main elements of the wire tensioning apparatus shown in FIG. 2.

FIG. 1 is a perspective view illustrating a wire tensioning apparatus according to the present invention; FIG. 2 is an exploded perspective view illustrating the wire tensioning apparatus shown in FIG. 1; FIG. 3 is an exploded cross-sectional view illustrating the main elements of the wire tensioning apparatus shown in FIG. 2; and FIG. 4 is a cross-sectional view illustrating the main elements of the wire tensioning apparatus shown in FIG. 2.

Referring to FIGS. 1 to 4, a wire tensioning apparatus 10 includes a main body unit 100, a fluid control unit 500, a wire-pulling unit 200, a wire engagement unit 300, a pressure-supporting unit 400, and a measurement unit 600.

The main body unit 100 includes a body 110, a first cover 120, and a second cover 130.

The body 110 is formed in a cylindrical shape having a predetermined length and includes a plurality of rod bores 111 defined therein in a lengthwise direction thereof. The body 110 has a fluid hole 112 formed on a circumferential side wall thereof so as to fluidically communicate with the plurality of rod bores 111. A first fluid pipe 113 connected to a fluid pump (not shown) is engaged to the fluid hole 112 so that fluid can be introduced into the rod bores 111 through the fluid hole 112. The introduced fluid may be discharged to the outside through the fluid hole 112. A first cap 114 and a second cap 115 are disposed in each of the rod bores 111 to prevent the introduced fluid from being leaked out. The first cap 114 and the second cap 115 of each rod bore are spaced away from each other, and the second cap 115 has a guide hole 116 formed at the center thereof. In addition, the second cap 115 has at least one pipe-engaging hole 117 formed thereon. The first and second caps 114 and 115 may be made of rubber, or the like, and the material of the first and second cap is not limited to the rubber.

The body 110 has a handle 140 joined to the outer circumferential wall thereof so that the body 110 can be carried conveniently by using the handle 140.

The first cover 120 is joined to one end of the body 110 and has a plurality of through-holes 121 formed therein so as to fluidically communicate with the plurality of rod bores 111. The first cover 120 may be inserted into the body 110. A bushing 122 that is internally perforated in a lengthwise direction thereof is engaged to each of the through-holes 121.

The second cover 130 is joined to the other end of the body 110 and has a plurality of pipe-inserting holes 131 formed therein so as to fluidically communicate with the pipe-engaging holes 117 of the second caps 115. Further, the second cover 130 has a plurality of wire holes 132 formed therein.

The first cover 120 and the second cover 130 are joined to the body 110 in a bolt-fastening manner. The joining structure of the first and second covers may be variously modified.

Next, the fluid control unit of the wire tensioning apparatus according to the present invention will be described hereinafter with reference to FIGS. 4 to 6.

Figure 5:
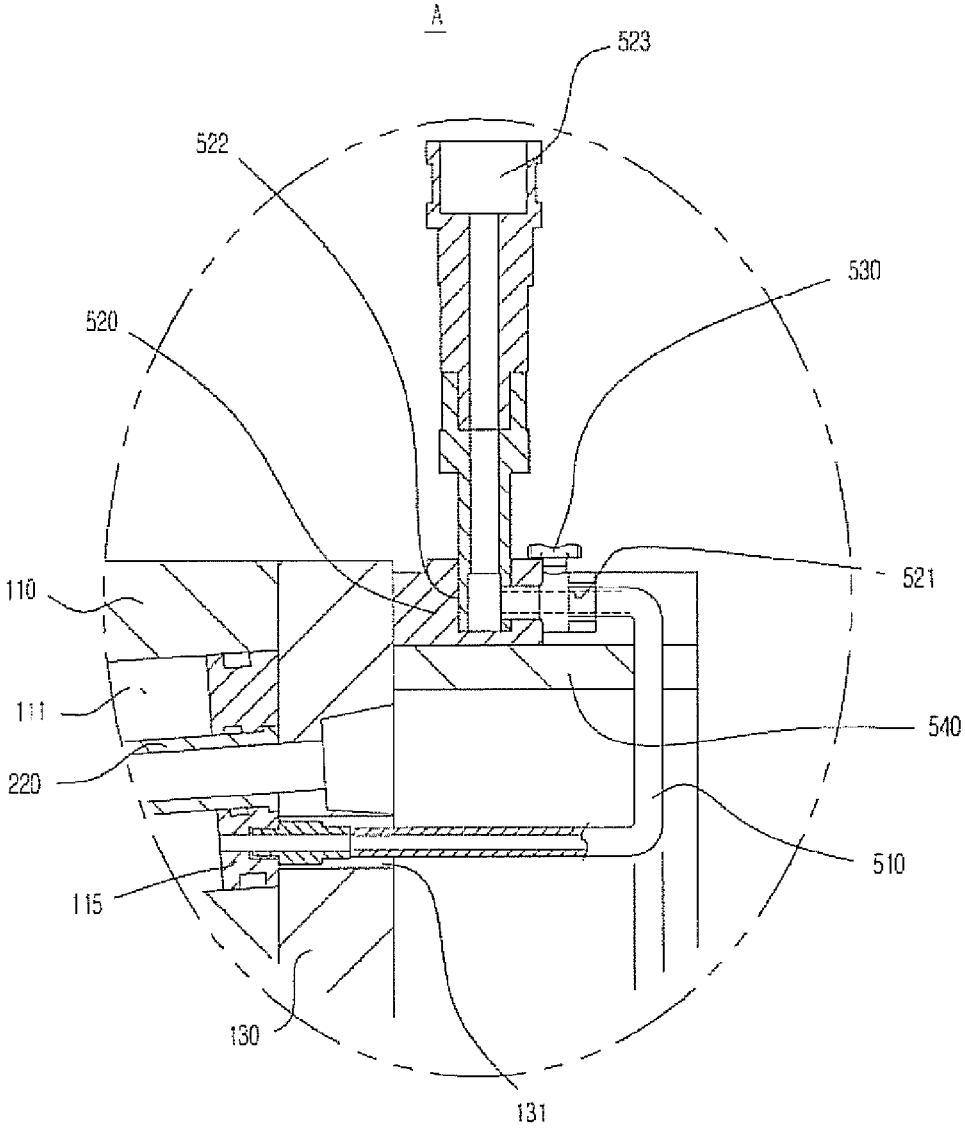
FIG. 5 is a partially enlarged view of a portion A indicated in FIG. 4.
Figure 6:
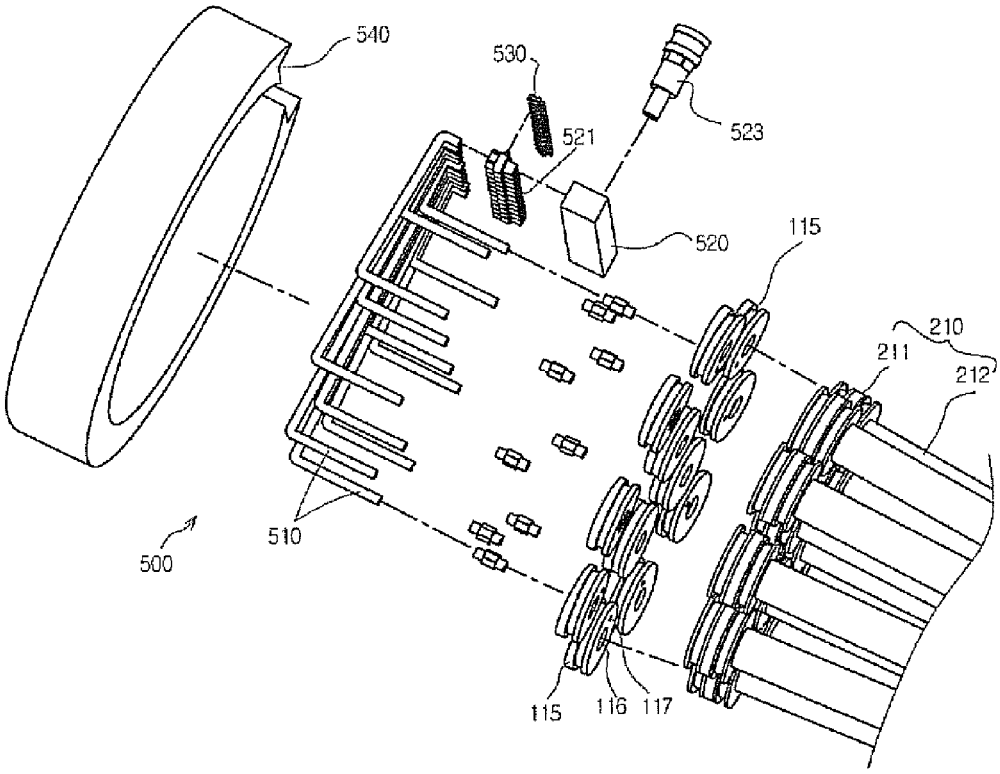
FIG. 6 is an exploded perspective view illustrating a fluid control unit shown in FIG. 2.

FIG. 5 is a partially enlarged view of a portion A indicated in FIG. 4, and FIG. 6 is an exploded perspective view illustrating a fluid control unit shown in FIG. 2.

Referring to FIGS. 4 to 6, the fluid control unit 500 includes a plurality of pipes 510, a fluid block 520, and a pipe cover 540

The pipe cover 540 is joined to the second cover 130 and the pipes 510 are disposed inside the pipe cover 540. The pipes 510 are connected at one ends thereof to the rod bores 111 through the pipe-inserting holes 131 of the second cover 130 and the pipe-engaging holes 117 of the second caps 115.

A flow block 520 having a plurality of flow channels 521 is joined to the pipe cover 540. The pipes 510 are connected at other ends thereof to the flow channels 521 of the flow block 520, and a plurality of valves 530 is engaged to the flow channels 521 to open or close the flow channels 521. In addition, the fluid block 520 has a plurality of flow channel holes 522 formed therein so as to fluidically communicate with the plurality of flow channels 521. Thus, fluid may be introduced into the other end of the body 110, i.e., the rod bores 111 in a state in which the valves 530 are opened, or the introduced fluid may be again discharged out. On the other hand, in a state in which the valves 530 are closed, fluid is not introduced into the rod bores 111 and the introduced fluid cannot be discharged out.

Subsequently, the wire-pulling unit 200 of the wire tensioning apparatus according to the present invention will be described hereinafter with reference to FIGS. 2 to 4.

Referring back to FIGS. 2 to 4, the wire-pulling unit 200 includes a plurality of rods 210 and a plurality of guide tubes 220.

Each of the rods includes a head 211 and a bar-shaped body 212.

The head 211 is disposed in each rod bore 111 to partition the rod bore 111 into two compartments. In this case, the outer circumferential surface of the head 211 is engaged with the inner circumferential surface of the rod bore 111 in a tightly sealed state. Fluids introduced into one side and the other side of the rod bore 111 do not pass through the head 211, and thus they join with each other in the rod bore 111. Accordingly, the head 211 can be displaced axially, i.e., in the direction where fluid flows within the rod bore. That is, when fluid is introduced into one side of the body 110 through the first fluid pipe 113, the head 211 forcibly pushes fluid staying at the other side of the body 110 while being displaced axially to the other side of the body 110. The forcibly pushed fluid is discharged to the outside through the pipes 510 in a state in which the valves 530 are opened. On the contrary, even if fluid is introduced into the one side of the body 110 in a state in which the valves 530 are closed, the head 211 will not be displaced. The bar-shaped body 212 is connected at one end thereof to the head 211. The bar-shaped body 212 is exposed at the other end thereof to the outside through the bushing 122 and has male threads formed on the outer circumferential surface of the other end thereof. Moreover, the bar-shaped body 212 is internally perforated in a lengthwise direction thereof. The bar-shaped body 212 is displaced axially together with the head 211. In other words, when the head 211 is displaced from one side to the other side by the fluid introduced into one side of the body 110 through the first fluid pipe 113 (i.e., the head 211 is retracted), the bar-shaped body 212 is also displaced from one side to the other side. On the other hand, when the head 211 is displaced from the other side to one side by the fluid introduced into the other side of the body 110 through the second fluid pipe 523 (i.e., the head 211 is advanced), the bar-shaped body 212 is also displaced from the other side to one side.

Each of the guide tubes 220 is internally perforated in a lengthwise direction thereof. The guide tubes 220 are engaged at one ends thereof to the wire holes 132 of the second cover 130 and are at least partially telescoped at the other ends thereof into the bar-shaped bodies 212.

By doing so, when the head 211 is displaced axially inside the rod bore 111, the guide tube 220 guides the bar-shaped body 212 to be displaced straightly without deflecting the bar-shaped body 212 downward in the rod bore 111.

Next, the wire engagement unit of the wire tensioning apparatus according to the present invention will be described hereinafter with reference to FIGS. 7 to 10.

Figure 7:
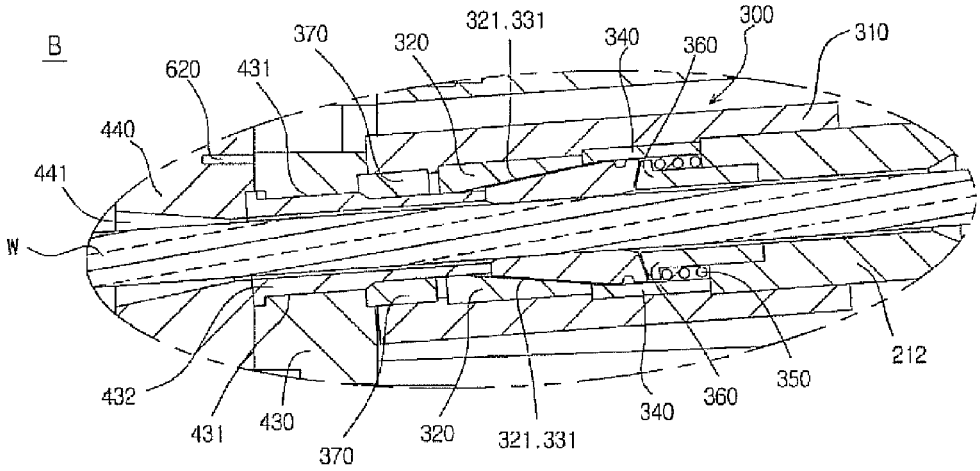
FIG. 7 is a partially enlarged view of a portion B indicated in FIG. 4.
Figure 8:
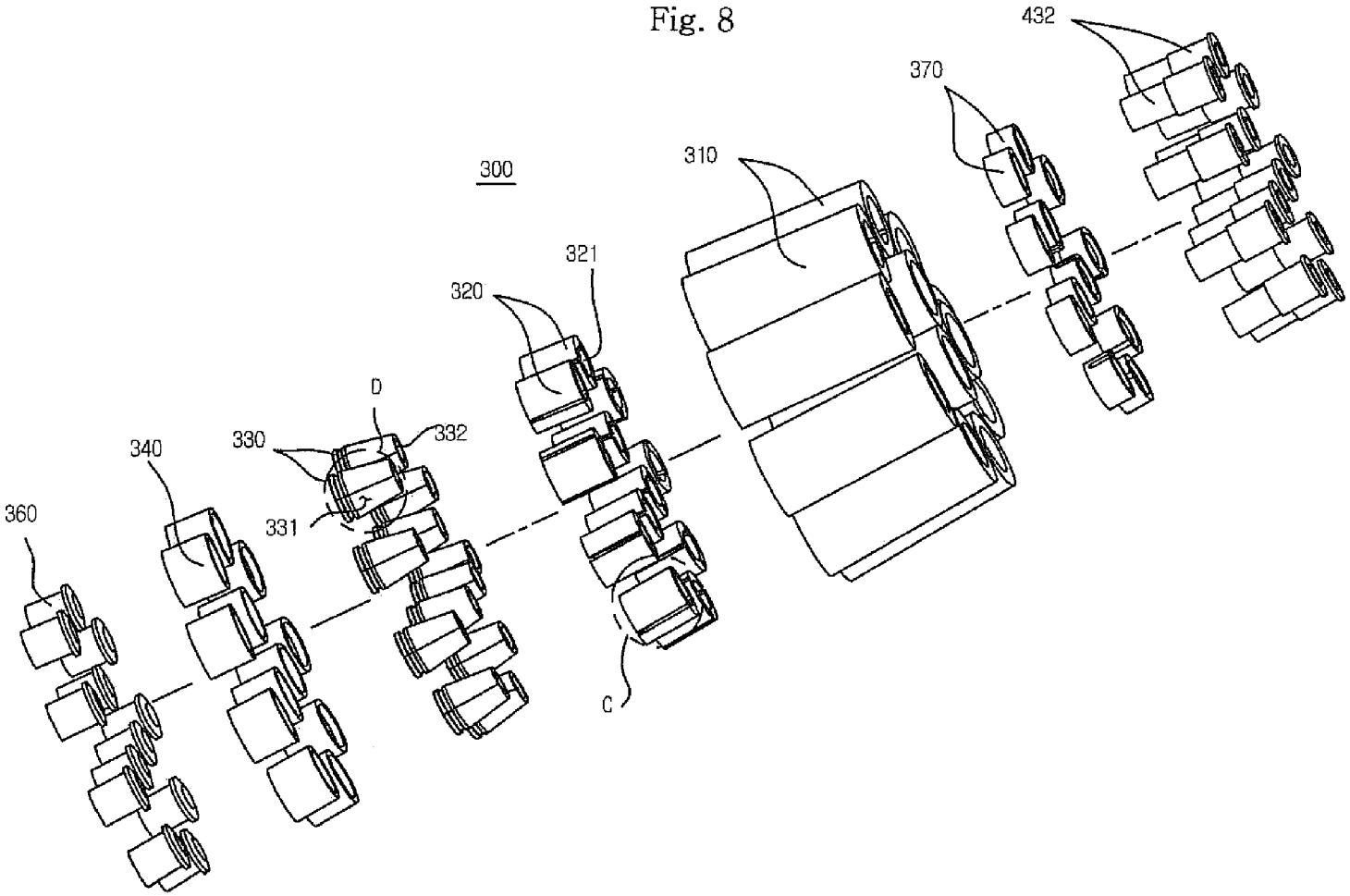
FIG. 8 is an exploded perspective view illustrating a wire engagement unit shown in FIG. 2.
Figure 9:
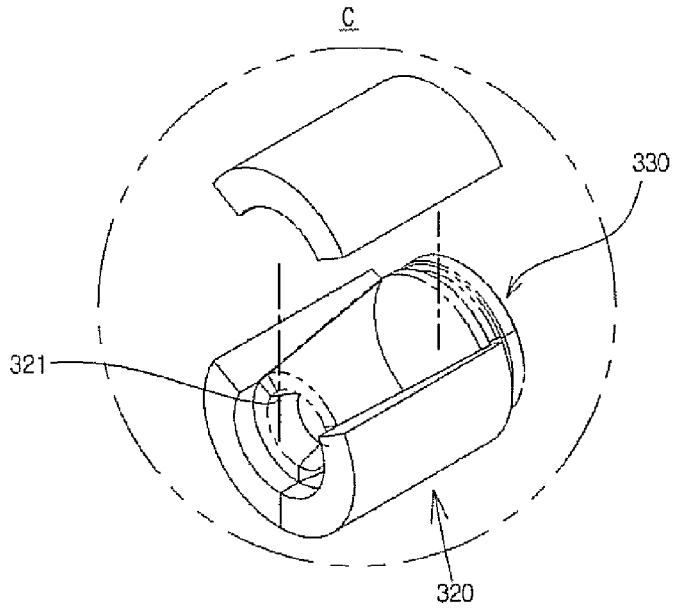
FIG. 9 is a partially enlarged view of a portion C indicated in FIG. 8.
Figure 10:
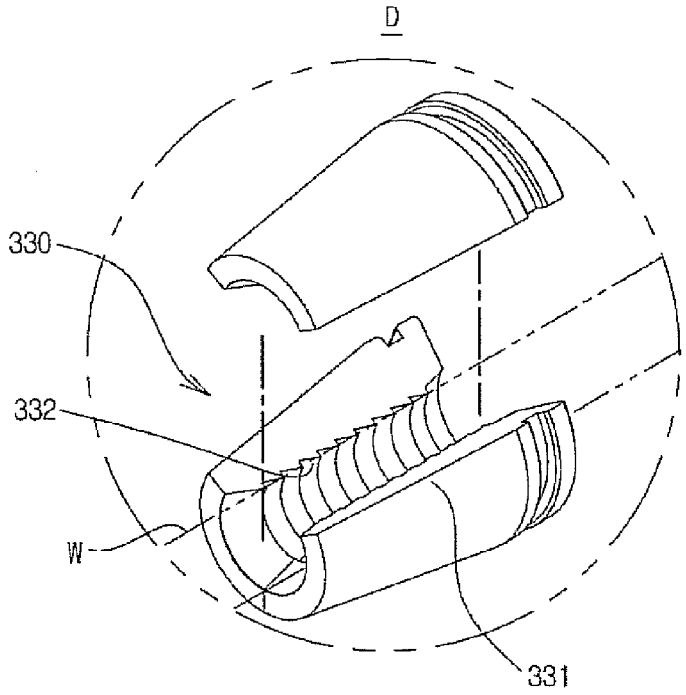
FIG. 10 is a partially enlarged view of a portion D indicated in FIG. 8.

FIG. 7 is a partially enlarged view of a portion B indicated in FIG. 4, FIG. 8 is an exploded perspective view illustrating a wire engagement unit shown in FIG. 2, FIG. 9 is a partially enlarged view of a portion C indicated in FIG. 8, and FIG. 10 is a partially enlarged view of a portion D indicated in FIG. 8.

Referring to FIGS. 7 and 8, the wire engagement unit 300 of the wire tensioning apparatus according to the present invention includes an engagement block 310, a clamp insert 320, a clamp block 330, and a buffer guide 360.

The engagement block 310 is internally perforated in a longwise direction and has female threads formed on the inner circumferential surface of one end thereof so as to be engaged with the male threads formed on the outer circumferential surface of the other end of the bar-shaped body 212. As such, the engagement block 310 and the bar-shaped body 212 are engaged with each other by a screw engagement manner. A clamp guide 340 is engaged to one side the inner circumferential surface of the engagement block 310, and a pin bushing 370 is engaged to the other end of the engagement block 310. The clamp guide 340 and the pin bushing 370 are internally perforated in a lengthwise direction thereof.

Referring to FIGS. 3, 7, and 9, the clamp insert 320 is disposed inside the engagement block 310 in such a fashion as to be interposed between the clamp guide 340 and the pin bushing 370. The engagement block 310 is internally perforated at the center thereof along a lengthwise direction thereof. The clamp insert 320 is divided into a plurality of arcuate segments. Alternatively, the clamp insert 320 may be formed in an integral shape, but not divided into plural segments. The clamp insert 320 is formed to have a tapered shape which is gradually reduced in inner diameter in a direction from one end side toward the other end side. Thus, the clamp insert 320 is formed with a tapered through-hole 321 running from one end side to the other end side on the inner circumferential surface thereof.

Referring to FIG. 10, the clamp block is internally perforated in a lengthwise direction thereof, and has a plurality of retaining jaws 332 formed on the inner circumferential surface thereof to clamp a wire W arranged inside an upper structure of a bridge, or the like. In this case, the wire W can be firmly clamped by the retaining jaws 332. The clamp block 330 is disposed inside the clamp insert 320. The outer diameter of the clamp block 330 is substantially equal to the inner diameter of the clamp insert 320. As a consequence, the clamp block 330 is formed to have a tapered shape which is gradually reduced in outer diameter in a direction from one end side toward the other end side. Thus, the clamp block 330 is formed with a tapered surface 331 running from one end side to the other end side on the outer circumferential surface thereof. The outer circumferential tapered surface 331 of the clamp block 330 is brought into close contact with the inner circumferential surface of the tapered through-hole 321 of the clamp insert 320 to cause the clamp block 330 to be pressed toward the inner center of the clamp insert 320. As a consequence, the outer periphery of the wire W is tightened and closely clamped by the inner circumferential surface of the clamp block 330. At this time, the wire W can more firmly clamped by the retaining jaws formed on the inner circumferential surface of the clamp block 330.

Thus, as shown in FIG. 7, when the bar-shaped body 212 is retracted, the wire W is pulled and tensioned.

The buffer guide 360 is disposed inside the clamp guide 340, and has a buffer member 350 disposed on the outer circumferential surface thereof. The buffer member 350 may be a spring. The buffering force of the buffer member 350 allows the outer circumferential tapered surface 331 of the clamp block 330 to be brought into close contact with the inner circumferential surface of the tapered through-hole 321 of the clamp insert 320. Thus, the outer circumferential tapered surface 331 of the clamp 330 and the inner circumferential surface of the tapered through-hole 321 continue to be maintained in a close contact state. By dong so, the clamp block 330 can more firmly clamp the wire W.

Now, the pressure-supporting unit 400 and the measurement unit 600 of the wire tensioning apparatus according to the present invention will be described hereinafter with reference to FIGS. 1 to 4.

Referring back to FIGS. 1 to 4, the pressure-supporting unit 400 includes a plurality of support bars 420, a pressure plate 430, a support plate 440, a support body 410, and a cover 450.

The support bar 420 is formed to have a predetermined length and is engaged at one end thereof to the first cover 120. The engagement between the support bar 420 and the first cover 120 can be performed in a screw engagement manner. The support bar 420 is engaged at the other end thereof to the pressure plate 430 having a plurality of fixing holes 431 formed therein. The engagement between the support bar 420 and the pressure plate 430 can also be performed in a screw engagement manner. The outer circumferential length of the pressure plate 430 is shorter than that of the body 110. Fixing pins 432 are engaged to the pressure plate 430. The fixing pins 432 are engaged at one ends thereof to the fixing holes 431 and are engaged at the other ends thereof to the inside of the pin bushing 370. The fixing pins 432 can be disengaged from or engaged with the wire engagement unit 300. The wire W is inserted into the fixing pin 432 and is clamped by the clamp block 330.

The support plate 440 is engaged to the front side of the pressure plate 430, and has a plurality of insertion holes 441 formed therein so as to allow the wire W to be inserted thereto. The wire W inserted into the insertion hole 441 is passed through the wire hole 132 of the second cover 130 and is extended to the outside. Alternatively, the inserted wire W may be not extended to the outside.

Figure 12:
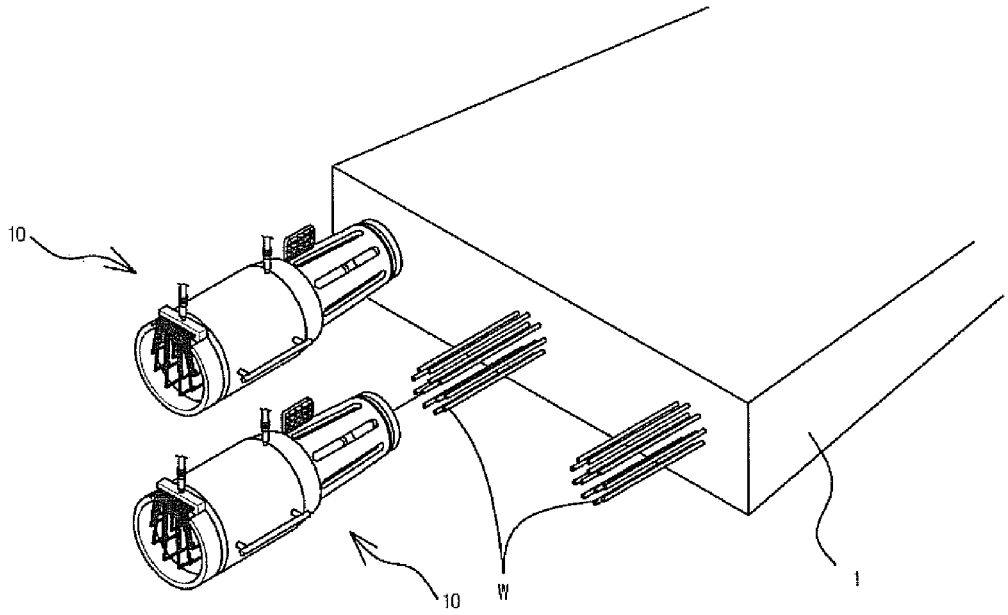
FIG. 12 is a perspective view illustrating a state in which the wire tensioning apparatus according to the present invention is in use.

The support plate 440 is engaged to the pressure plate 430 in a screw engagement manner. The support plate 440 is brought into close contact with an upper structure at the time of tensioning the wire as shown in FIG. 12.

The support body 410 is disposed between the body 110 and the pressure plate 430 to surround the plurality of bar-shaped bodies 212 and the plurality of support bars 420 in their entirety. The support body 410 is joined at one end thereof to the pressure plate 430 and is joined at the other end thereof to the body 110. The support body 410 is formed to have a tapered shape which is gradually reduced in outer diameter in a direction from the other end, i.e., the body 110 side to one end, i.e., the pressure plate 430 side. That is, the outer circumferential surface of the support body 410 is tapered as it goes toward one end from the other end. By doing so, since the diameter of the support plate in close contact with the upper structure is smaller than that the body 110, the tensioning apparatus can continue to be used even in a narrow place.

The cover 450 surrounds the support body 410 and the cylindrical body 110 together so that support body 410 can be firmly joined to the body 110.

The pressure-supporting unit 400 supports the pressure generated when the wire-pulling unit 200 pulls the wire W in a state in which the support plate 440 is in close contact with the upper structure 1.

The measurement unit 600 includes a detecting sensor 620 and a display part 610.

Figure 11:
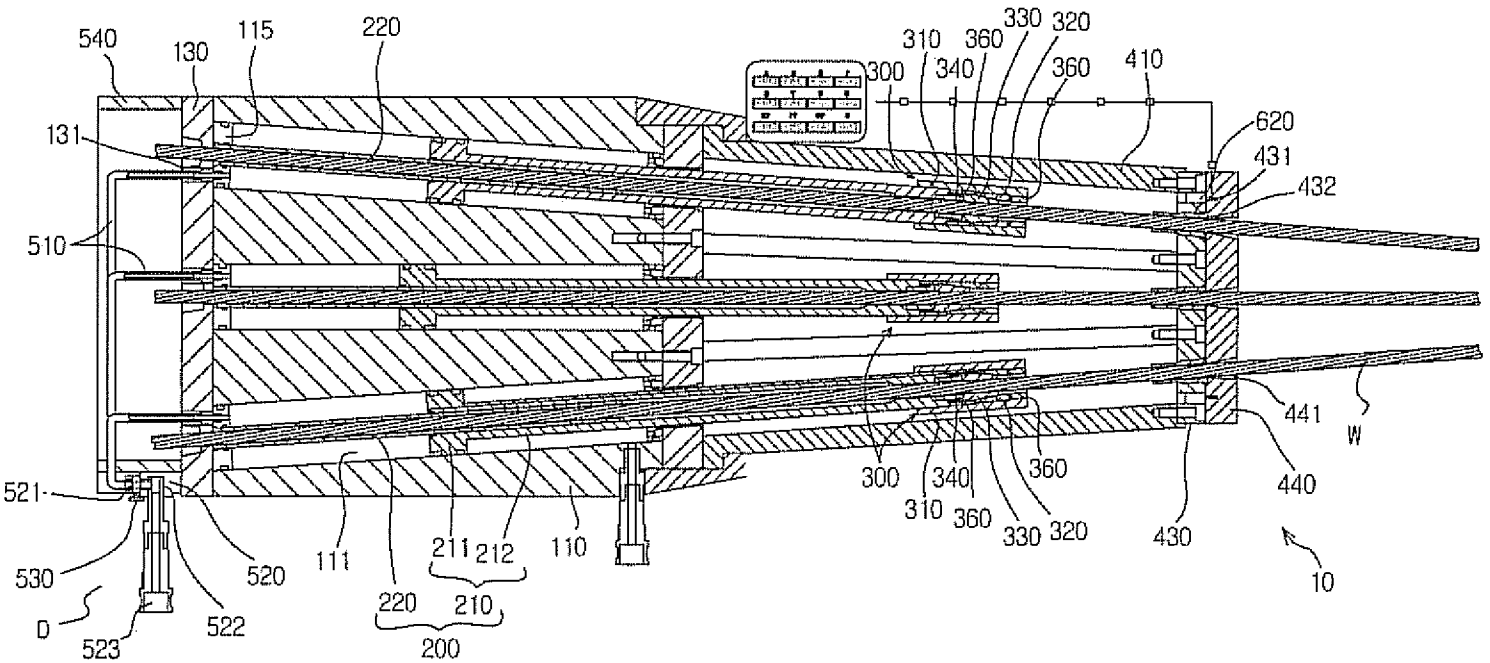
FIG. 11 is a cross-sectional view illustrating the wire tensioning apparatus according to the present invention in a state in which wires are tensioned tightly.

The detecting sensor 620 is disposed in the pressure-supporting unit 400, but may be joined to the wire-pulling unit 200. The detecting sensor 20 measures the distance of the wire engagement unit 300 axially displaced when the wire-pulling unit 200 is retracted as shown in FIG. 11. The measured distance is displayed on the display part 610, so that when the head 211 tensions the wire W while being retracted, the length of the tensioned wire W can be identified externally through the display part 610.

As such, the length of the wire W tensioned can be easily checked by the measurement unit 600. Since the operation of the heads 121 depends on a state in which the valve 530 is opened or closed, only a necessary head 211 of the wire-pulling unit 200 can be operated.

Next, the operation of the present invention will be described hereinafter with reference to FIGS. 3, 11, and 12.

First, the clamp block 330 is joined to the pressure plate 430 constituting the pressure-supporting unit 400, and a wire W arranged inside an upper structure such as a bridge or the like is fitted into the clamp block 330. At this time, the wire W is firmly clamped by the retaining jaws 332 formed on the inner circumferential surface of the clamp block 330.

In this case, if the wire is tensioned, fluid is supplied to the rod bore 111 through the first fluid pipe 113. Then, the head 211 fitted into each of the rod bores 111 of the body 110 and the bar-shaped body 212 fitted into each of the guide tubes 220 are moved in the retraction direction by the pressure of the fluid injected into the rod bore 111 to cause the wire W to be tensioned. In this case, since the bar-shaped body 212 is firmly fitted into the guide tube 220, it is prevented from being deflected downward.

Each of the rod bore 111 fluidically communicates with the hole of the pipe 510 of the fluid control unit 500 through the pipe-inserting hole 131. Thus, when the head 211 is retracted within the rod bore 111, the fluid staying in the rod bore 111 is discharged to the outside through the second fluid pipe 523 via the pipe 510.

The distance of the wire engagement unit 300 displaced axially upon the retraction of the head 211 and the bar-shaped body 212 of the wire-pulling unit 200 is measured by the detecting sensor 620 disposed in the pressure-supporting unit 400 so that the tensioned length of the wire W can be checked externally through the display part.

In the course of pulling the wire W by a designed tensile force, a tensile force can be imparted to only a wire needed to be tensioned. In other words, if only a wire needed to be tensioned is selected and pulled forcibly in a state in which the wires W are disposed in the rod bores 111 of the body 110, the movement of fluids staying in the remaining rod bores except the rod bore 111 in which the relevant wire is disposed is interrupted. This is achieved by closing the valves 530 installed on the pipes serving to move fluids within the remaining rod bores 111. When fluid is injected into the relevant rod bore 111 through the first fluid pipe 113 to cause the rod 210 in the rod bore 111 to be retracted, only fluid staying in the rod bore 111 fluidically communicating with a flow channel 521 on which the valve is opened is discharged out through the second fluid pipe 523 to stretch the relevant wire. On the other hand, the flow channels of the remaining rod bores 111 except the relevant rod bore 111 from which fluid escapes are blocked by closing the valves installed on the flow channels, so that there are both no movement of fluid and accordingly no retraction of the rods 210 within the remaining rod bores 111. Through this operation mechanism, a tensile force can be selectively imparted to only a desired rod 210 connected to the wire W.

As described above, the present invention can be utilized in a structure construction field in which a wire bundle is selectively tensioned to prevent the downward deflection of an upper structure of a bridge or the like According to the exemplary embodiment of the present invention, the pipes are connected at one ends thereof to respective rod bores in which rods that pull wires by the pressure of fluid are inserted, and are connected at the other ends thereof to the flow channels of the valves engaged to the fluid block so that the flow channels can be opened or closed by the operation of the valves. When the flow channels are closed, the rods connected thereto are not operated. Thus, a necessary rod to which a wire is connected can be selectively operated.

In addition, according to the exemplary embodiment of the present invention, the wire-pulling unit including the rods, the rod body, and the guide tubes is tapered in a direction from one side to the other side. That is, the inventive wire tensioning apparatus has a tapered shape which is reduced in diameter as it goes toward the other side from one side. Thus, the entire volume of the wire tensioning apparatus can be minimized and any interference with other wire tensioning apparatuses is avoided so that the wire can be smoothly tensioned.

While the present invention has been described with respect to the specific embodiments, it will be apparent to those skilled in the art that various changes and modifications may be made without departing from the spirit and scope of the invention as defined in the following claims.

What is claimed is:

1. A wire tensioner comprising:

a body including a plurality of rod bores axially defined therein;

a plurality of rods configured so that each rod, of the plurality of rods, separately supports a corresponding wire of a plurality of wires from a structure and introduces a tensile force to the corresponding wire of the plurality of wires, wherein the plurality of rods are disposed in the plurality of rod bores to guide the axial displacement of the plurality of rods in the plurality of rod bores;

a fluid pressure providing unit configured to provide fluid pressure to the plurality of rods in order to allow the plurality of rods to exhibit the tensile force;

a fluid control unit, connected at one side thereof to the plurality of rods and connected at the other side thereof to the fluid pressure providing unit, and configured to selectively interrupt fluid pressure provided to the plurality of rods to separately control the operation of a selected rod of the plurality of rods;

a wire engagement unit installed at a front end of the body and configured to fixedly engage the plurality of rods and the plurality of wires with each other; and a pressure-supporting unit comprising a plurality of support bars having ends connected to the body, a pressure plate engaged to other ends of the support bars, and a plurality of fixing pins engaged with the pressure plate to allow the wire engagement unit to be disengaged from or engaged with the pressure-supporting unit.

2. The wire tensioner according to claim 1, further comprising:

a support body, disposed between the body and the pressure plate, to surround the plurality of rods, the support body having a shape that tapers away from the body.

3. The wire tensioner according to claim 1, wherein each rod, of the plurality of rods, comprises a head configured to partition each rod bore, of the plurality of rod bores, into two compartments; and a bar-shaped body extending from one end of the head and configured to support a wire, of the plurality of wires, while allowing the wire to pass through the bar-shaped body.

4. The wire tensioner according to claim 3, further comprising:

a guide tube disposed in a telescoping manner within the bar-shaped body and configured to guide the bar-shaped body in a rod bore, of the plurality of rod bores, so that the bar-shaped body is not deflected downward when the head is axially displaced within the rod bore.

5. The wire tensioner according to claim 1, wherein the fluid control unit comprises:

a plurality of pipes, wherein each pipe, of the plurality of pipes, communicates with a corresponding rod bore, of the plurality of rod bores, to provide an introduction and discharge path of the fluid pressure;

a fluid block including a plurality of flow channels, wherein each flow channel, of the plurality of flow channels fluidically communicates with a corresponding pipe of the plurality of pipes; and a plurality of valves, wherein each valve, of the plurality of valves, is installed at a corresponding flow channel, of the plurality of flow channels, to selectively open or close the introduction and discharge path of the fluid pressure.

6. The wire tensioner according to claim 5, wherein the plurality of valves comprise solenoid valves that are opened or closed using an electronic control.

7. The wire tensioner according to claim 1, wherein each rod bore, of the plurality of rod bores, is divided into two hermetically sealed compartments divided by a corresponding rod, of the plurality of rods, and wherein the fluid pressure providing unit comprises a fluid pipe installed at one side of an outer circumferential surface of the body to fluidically communicate with one of the two hermetically sealed compartments in order to provide the fluid pressure to the one of the two hermetically sealed compartments.

8. The wire tensioner according to claim 1, wherein the wire engagement unit comprises:

an engagement block having a plurality of longitudinally extending openings, the engagement block being fixed at one side thereof to the plurality of rods and being disengaged from or engaged with the plurality of fixing pins at another side thereof;

a clamp insert disposed inside the engagement block, the clamp insert having a plurality of segments tapered in a longitudinal direction of the plurality of segments;

a clamp block inserted into the clamp insert, the clamp block having a plurality of segments having a plurality of longitudinally extending openings, wherein the plurality of segments are tapered in a longitudinal direction of the plurality of segments extending;

a buffer guide disposed between the clamp block and the plurality of rods; and a buffer member disposed on an outer circumferential surface of the buffer guide.

9. The wire tensioner according to claim 1, further comprising:

a detecting sensor joined to the pressure plate and configured to detect an axial displacement of the wire engagement unit; and a screen display part connected to the detecting sensor and configured to display a distance of the axial displacement of the wire engagement unit.

10. A wire tensioner comprising:

a body including a plurality of rod bores axially defined therein to allow each wire, of a plurality of wires, from a structure, to pass through a corresponding rod bore of the plurality of rod bores;

a rod, of a plurality of rods, disposed inside each rod bore, of the plurality of rod bores, and configured to introduce a tensile force by dividing each rod bore, of the plurality of rod bores, into two compartments;

a wire engagement unit installed at a front end of the body and configured to fixedly engage each wire, of the plurality of wires, to a corresponding rod of the plurality of rods;

a first fluid pressure providing unit configured to provide fluid pressure to one of the two compartments to allow a corresponding rod, of the plurality of rods, to be axially displaced in a direction of the tensile force;

a fluid control unit including a plurality flow channels that pass through the body to fluidically communicate with the plurality of rod bores, wherein the plurality of flow channels are configured to separately open or close to control the operation of the plurality of rods; and a pressure-supporting unit comprising:

a plurality of support bars having ends connected to the body, a pressure plate engaged with other ends of the support bars, and a plurality of fixing pins engaged with the pressure plate to allow the wire engagement unit to be disengaged from or engaged with the pressure-supporting unit.

11. A wire tensioner comprising:

a body including a plurality of rod bores axially defined therein;

a plurality of rods having a predetermined length, wherein the plurality of rods are inserted, at first ends, into corresponding ones of the plurality of rod bores, so as to allow the plurality of rods to be axially displaced along the plurality of rod bores;

a wire engagement unit to receive second ends of the plurality of rods and to be axially displaced by the axial displacement of the plurality of rods;

a pressure-supporting unit comprising:

a plurality of support bars having a predetermined length and having ends connected to the body, a pressure plate engaged with other ends of the support bars, and a plurality of fixing pins engaged with the pressure plate to allow the wire engagement unit to be disengaged from or engaged with the pressure-supporting unit; and a fluid control unit comprising:

a plurality of pipes communicating with the plurality of rod bores, a plurality of flow channels fluidically communicating with interiors of the plurality of pipes, a fluid block having plurality of flow channel holes connected to corresponding ones of the plurality of flow channels, and a plurality of valves engaging corresponding ones of the plurality flow channels to selectively interrupt the corresponding ones of the plurality of flow channels.

12. The wire tensioner according to claim 11, wherein the wire engagement unit comprises:

an engagement block having a plurality of longitudinally extending openings, the engagement block being fixed at one side thereof to the plurality of rods and being disengaged from or engaged with the plurality of fixing pins at another side thereof;

a clamp insert disposed inside the engagement block, the clamp insert having a plurality of segments tapered in a longitudinal direction of the plurality of segments;

a clamp block inserted into the clamp insert, the clamp block having a plurality of segments having a plurality of longitudinally extending openings, wherein the plurality of segments are tapered in a longitudinal direction of the plurality of segments; and a buffer guide disposed between the clamp block and the plurality of rods; and a buffer member disposed on an outer circumferential surface of the buffer guide.

13. The wire tensioner according to claim 11, further comprising:

a support body, disposed between the body and the pressure plate to surround the plurality of rods, the support body tapering away from the body.

14. The wire tensioner according to claim 11, further comprising:

a detecting sensor joined to the pressure plate and configured to detect an axial displacement of the wire engagement unit; and a screen display part connected to the detecting sensor and configured to display a distance of the axial displacement of the wire engagement unit.

15. The wire tensioner according to claim 11, wherein each of the plurality of rods is internally perforated in a lengthwise direction and disposed in a corresponding one of the plurality of rod bores, wherein wire tensioning apparatus further comprises:

a plurality of guide tubes inserted at first ends into the plurality of rods and connected at second ends to the body, wherein the plurality of guide tubes guide the plurality of rods in the plurality of rod bores;

a plurality of first caps disposed at the first ends of the plurality of rod bores to allow the plurality of rods to pass therethrough; and a plurality of second caps disposed at the second ends of the plurality of rod bores, wherein each of the plurality of second caps allows a corresponding pipe, of the plurality of pipes, to communicate with a corresponding one of the plurality of rod bores.

* * * * *